US005637447A

United States Patent [19]

Dickerson et al.

[11] Patent Number: 5,637,447

[45] Date of Patent: Jun. 10, 1997

[54] FILMS FOR REPRODUCING DIGITALLY STORED MEDICAL DIAGNOSTIC IMAGES

[75] Inventors: Robert E. Dickerson, Hamlin; Richard E. Beal, Ontario; Franklin C. Brayer, Rochester; Stephen A. Hershey, Fairport; Patrick M. Jeffries, Pittsford, all of N.Y.

[73] Assignee: Eastman Kodak Company, Rochester, N.Y.

[21] Appl. No.: 574,508

[22] Filed: Dec. 19, 1995

[51] Int. Cl.[6] ..... G03C 1/005

[52] U.S. Cl. ..... 430/567; 430/487; 430/944; 430/966

[58] Field of Search ..... 430/966, 487, 430/567, 944

[56] References Cited

U.S. PATENT DOCUMENTS

| | | | |
|---|---|---|---|
| 3,827,886 | 8/1974 | Ishihra et al. | 430/355 |
| 4,801,523 | 1/1989 | Tufano | 430/589 |
| 4,960,683 | 10/1990 | Okazaki et al. | 430/428 |
| 5,260,178 | 11/1993 | Harada et al. | 430/508 |
| 5,420,001 | 5/1995 | Ito et al. | 430/567 |
| 5,474,879 | 12/1995 | Fitterman et al. | 430/487 |

FOREIGN PATENT DOCUMENTS

| | | | |
|---|---|---|---|
| 0 458 277 A2 | 11/1991 | European Pat. Off. | G03C 5/38 |
| 0 569 008 A1 | 11/1993 | European Pat. Off. | G03C 7/42 |

*Primary Examiner*—Mark F. Huff

*Attorney, Agent, or Firm*—Carl O. Thomas

[57] ABSTRACT

A radiation-sensitive film for reproducing digitally stored medical diagnostic images through a series of laterally offset exposures by a controlled radiation source followed byprocessing in 90 seconds or less including development, fixing and drying is disclosed. The film exhibits an average contrast in the range of from 1.5 to 2.0, measured over a density above fog of from 0.25 to 2.0. An emulsion is provided in which silver bromochloride grains provided (a) containing at least 10 mole percent bromide, based on silver, (b) having a mean equivalent circular diameter of less than 0.40 μm, (c) exhibiting an average aspect ratio of less than 1.3, and (d) coated at a silver coverage of less than 40 mg/dm$^2$. Adsorbed to the surfaces of the silver bromochloride grains is at least one spectral sensitizing dye having an absorption half peak bandwidth in the spectral region of exposure by the controlled exposure source. The film also contains an infrared opacifying dye capable of reducing specular transmission through the film before, during and after processing to less than 50 percent, measured at a wavelength within the spectral region of from 850 to 1100 nm.

19 Claims, No Drawings

FILMS FOR REPRODUCING DIGITALLY STORED MEDICAL DIAGNOSTIC IMAGES

FIELD OF THE INVENTION

The invention is directed to silver halide containing films for reproducing digitally stored medical diagnostic images.

DEFINITION OF TERMS

In referring to grains or emulsions containing two or more halides, the halides are named in order of ascending concentrations.

The "aspect ratio" of a grain is the ratio of its equivalent circular diameter (ECD) to its thickness. The ECD of a grain is the diameter of a circle having an area equal to the projected area of the grain.

The "coefficient of variation" (COV) of grain size (ECD) is defined as 100 times the standard deviation of grain size divided by mean grain size.

The term "covering power" is used to indicate 100 times maximum density divided by silver coating coverage measured in $g/dm^2$.

The term "cold" in referring to image tone is used to mean an image tone that has a CIELAB b* value measured at a density of 1.0 above minimum density that is −6.5 or more negative. Measurement technique is described by Billmeyer and Saltzman, Principles of Color Technology, 2nd Ed., Wiley, New York, 1981, at Chapter 3. The b* values describe the yellowness vs. blueness of an image with more positive values indicating a tendency toward greater yellowness.

The term "rapid access processor" is employed to indicate a radiographic film processor that is capable of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "average contrast" is employed to indicate contrast measured over the density range of from 0.25 to 2.0 above fog. Contrast is, of course, the ratio of $\Delta D \div \Delta \log E$, where D is density and E is exposure in lux-seconds.

The term "high intensity reciprocity failure" (HIRF) is employed to indicate a progressive reduction in speeds observed at equal exposures within the range of exposure times of from $10^{-1}$ to $10^{-9}$ second.

The "half peak absorption bandwidth" of a dye is the spectral range in nm over which it exhibits a level of absorption equal to at least half of its peak absorption ($\lambda$max).

The term "thiaalkylene bis(quaternary ammonium) salt" is employed to describe salts containing two ammonio groups joined through a thiaalkylene linkage. Ammonio groups are those that contain at least one of the following quaternary nitrogen atoms:

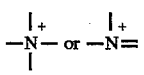

A "thiaalkylene" linkage is an alkylene linkage including at least one divalent sulfur atom replacing a carbon.

*Research Disclosure* is published by Kenneth Mason Publications, Ltd., Dudley House, 12 North St., Emsworth, Hampshire P010 7DQ, England.

BACKGROUND

Roentgen discovered X-radiation by the inadvertent exposure of a silver halide photographic element. In 1913 the Eastman Kodak Company introduced its first product specifically intended to be exposed by X-radiation. Silver halide radiographic elements account for the overwhelming majority of medical diagnostic images.

In recent years a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light emitting diode (LED) or a light bar (a linear series of independently addressable LED's). The image is recreated as a series of laterally offset pixels. Initially the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped to process radiographic films and are familiar with their image characteristics.

A typical film, Kodak Ektascan HN™, for creating a hard copy of a digitally stored medical diagnostic image includes an emulsion layer coated on a clear or blue tinted polyester film support. The emulsion layer contains a red-sensitized silver iodobromide (2.5M % I, based on Ag) cubic grain (0.33 μm ECD) emulsion coated at a silver coverage of 30 $mg/dm^2$. A conventional gelatin overcoat is coated over the emulsion layer. On the back side of the support a pelloid layer containing a red-absorbing antihalation dye is coated. A gelatin interlayer, used as a hardener incorporation site, overlies the pelloid layer, and a gelatin overcoat containing an antistat overlies the interlayer. Developed silver is relied upon to provide the infrared density required to activate processor sensors. No dye is introduced for the purpose of increasing infrared absorption.

It is the prevailing practice to process radiographic films and the film described above in 90 seconds or less. For example, the Kodak X-OMAT 480 RA™ rapid access processor employs the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer (hereinafter referred to as Developer A) exhibits the following composition:

| | |
|---|---|
| Hydroquinone | 30 g |
| Phenidone™ | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |

-continued

| | |
|---|---|
| Glutaraldehyde | 4.9 g |
| Water to 1 liter/pH 10.0 | |

A typical fixer exhibits the following composition:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9–4.5 | |

Radiographic film processors such as RA 480 are capable of exposing large amounts of film over extended periods of time (e.g., a month or more) before its processing solutions are drained and replaced. Extended use of the processing solutions is made possible by the addition of small amounts of developer and fixer replenishers as each film is processed to compensate for developer and fixer losses by evaporation and film pick up.

Harada et al U.S. Pat. No. 5,260,178 has noted that if the silver halide coating coverage of a radiographic element is quite low, it is impossible for sensors that rely on the attenuation of near infrared sensor beams by silver halide grains to sense the presence of the film in the processor. Hence replenishers are not automatically added to the processing solutions, and the useful life of the processing solutions is markedly decreased. To overcome this problem Harada et al suggested adding to radiographic elements having low silver halide coating coverages an aggregated tricarbocyanine dye having at least two acidic (e.g., sulfonic acid or carboxylic acid) substituents and an absorption peak that is bathochromically shifted by at least 50 nm when aggregated as compared to its absorption in solution. The dye as aggregated in the radiographic film attenuates the infrared sensor beam to provide the necessary signal to turn on the processor. However, once the dye has entered the processing solution (as is insured by the presence of the acidic groups), it is no longer capable of attenuating the infrared sensor beam. Instead developed silver is used to control processor shut off. When the beam of the sensor controlling shut off ceases to be attenuated by developed silver, thereby indicating the film has passed through the processor, the processor is automatically turned off.

Thiaalkylene bisquaternary ammonium salts have been employed for a variety of purposes in silver halide photography. They are, for example, thioethers and hence capable of acting as grain ripening agents. They have been used in fixers, as illustrated by Schmittou EPO 0 569 008, Watanabe EPO 0 458 277 and Okazaki U.S. Pat. No. 4,960,683. Ishihara et al U.S. Pat. No. 3,827,886 discloses their utility as fog reducing agents in combination with 4-hydroxy-6-methyl-1,3,3a,7-tetraazaindene.

SUMMARY OF THE INVENTION

In one aspect this invention is directed to a radiation-sensitive silver halide film for reproducing digitally stored medical diagnostic images through a series of laterally offset exposures by a controlled radiation source followed by processing in 90 seconds or less, including development, fixing and drying, comprised of a transparent film support and, coated on the support, a hydrophilic colloid layer unit containing a silver halide emulsion, wherein (A) the film exhibits an average contrast in the range of from 1.5 to 2.0, measured over a density above fog of from 0.25 to 2.0, (B) the emulsion layer (1) contains silver bromochloride grains (a) comprised of at least 10 mole percent bromide, based on silver, (b) having a mean equivalent circular diameter of less than 0.40 μm, (c) exhibiting an average aspect ratio of less than 1.3, and (d) coated at a silver coverage of less than 40 mg/dm$^2$, and (2) has adsorbed to the surfaces of the silver bromochloride grains at least one spectral sensitizing dye having an absorption half peak bandwidth in the spectral region of exposure by the controlled exposure source, and (C) the film contains an infrared opacifying dye that is capable of reducing specular transmission through the film before, during and after processing to less than 50 percent, measured at a wavelength within the spectral region of from 850 to 1100 nm.

The films of the invention consume lower amounts of developer than the films now in use commercially. This allows the operators of rapid access processing equipment to reduce the amount of replenisher used during processing and/or to increase the interval between developer solution replacement. This translates into less spent processing solution requiring disposal and less rapid access processor down time for servicing.

The films also achieve a better balance between cold image tones and minimum density. The films of the invention are capable of providing negative b* values without the incorporation of any blue dye. This offers an image tone advantage over conventional films that are coated on clear, undyed supports.

The conventional technique for shifting b* values to −6.5 more negative to obtain cold image tones is to incorporate a blue dye in the film, usually in the support. Unfortunately the blue dye not only shifts b* values to more negative numbers to the cold image tone range (−6.5 or more negative), but also increases the neutral density of the film, thereby raising minimum density. The films of the invention rely on the emulsions for a greater contribution to cold image tones and thereby require lower dye levels and exhibit lower neutral minimum densities at comparable b* values.

The silver halide grains of the films do not provide sufficient infrared refraction to activate sensors that signal film entry into a radiographic film processor. Although the films exhibit adequate covering power and produce silver images of sufficient density for viewing, as a result of reducing silver coating coverages the silver images that the films produce can also be marginal or inadequate in terms of activating sensors relied upon to shut off radiographic film processors automatically. However, the films of the invention have been modified so that they remain compatible with radiographic film processors relying on near infrared sensors for start up and shut down.

Finally, the films of the invention retain the rapid processing characteristics of conventional radiographic films and are believed to be capable of even more rapid processing.

DESCRIPTION OF PREFERRED EMBODIMENTS

A typical film satisfying the requirements of the invention exhibits the following structure:

| |
|---|
| SURFACE OVERCOAT (SOC-1) |
| INTERLAYER (IL-1) |
| EMULSION LAYER (EL) |
| SUBBING LAYER (SL) |
| TRANSPARENT FILM (TF) |

-continued

| |
|---|
| SUBBING LAYER (SL) |
| PELLOID (PL) |
| INTERLAYER (IL-2) |
| SURFACE OVERCOAT (SOC-2) |

SL and TF together form a transparent film support. While a support in its simplest form can consist of any flexible transparent film, it is common practice to modify the surfaces of photographic and radiographic film supports by providing subbing layers to promote the adhesion of hydrophilic colloids to the support. Although any conventional photographic film support can be employed, it is preferred to employ a radiographic film support, since this maximizes compatibility with the rapid access radiographic film processors in which the films of the invention are intended to be processed and provides a radiographic film look and feel to the processed film. Radiographic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processess films, whereas photographic films rarely, if ever, employ blue tinted supports. Radiographic film supports, including the incorporated blue dyes that contribute to cold image tones, are described in *Research Disclosure,* Item 18431, cited above, Section XII. Film Supports. *Research Disclosure,* Vol. 365, September 1994, Item 36544, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene naphthenate) are specifically preferred polyester film supports.

SOC-1, IL-1 and EL together form a first processing solution permeable layer unit. PL, IL-2 and SOC-2 together form a second processing solution layer unit. Of all the layers in both layer units only the emulsion layer EL is essential. One function of the second layer unit is to balance the forces exerted by the first layer unit that would otherwise cause the film to curl. The anticurl function is primarily performed by the pelloid layer PL. The pelloid also provides a convenient site for dyes that are not required to interact with the emulsion layer EL. For example the pelloid layer is a preferred location for an antihalation dye. The other layers are provided to enhance the physical handling characteristics of the element and to provide convenient sites for modifying addenda.

In the simple, illustrative form shown film I contains a single emulsion layer EL. The emulsion grains have been chosen to offer a particularly advantageous combination of properties:

(1) Rapid processing, allowing compatibility with rapid access processors (including those having dry-to-dry processing in less than 40 seconds) used for radiographic films;

(2) High covering power, allowing low silver coating coverages; and (3) Enhanced image tone properties—that is, negative b* values when coated in films lacking blue dye incorporation and cold image tones with lower minimum densities when coated in films containing blue dye.

These properties are in part achieved by choosing emulsions containing silver bromochloride grains. Since the emulsions are intended to be exposed by a controlled radiation source, typically a laser, a slight increase in imaging speed that might be gained by iodide incorporation offers little or no practical benefit and is, in fact, a significant disadvantage when the reduction of development and fixing rates produced by iodide incorporation are taken into consideration. Iodide also contributes to warmer image tone. Thus, the grains as contemplated for use are substantially free of iodide.

The grains contain at least 50 mole percent chloride. It is known that silver chloride exhibits a higher level of solubility than other photographic halides and hence the fastest development and fixing rates. While this might suggest the use of pure silver chloride emulsions in the invention, this silver halide selection is not contemplated, since pure silver chloride emulsions have been observed to exhibit much lower covering power than the silver bromide and iodobromide emulsions conventionally employed in radiographic elements.

It has been discovered that, if at least about 10 mole percent bromide, based on total silver, is incorporated into the emulsion grains, covering power is increased to approximately the higher covering power levels of silver bromide, most commonly used in radiographic films. The grains preferably contain from about 20 to 40 mole percent bromide, based on total silver contained in the grains.

Bromide incorporated in the grains to increase covering power also shifts image tones; however, the emulsions retain negative b* values.

In addition to selecting the halide composition of the grains, the size of the grains is limited to increase the rate at which processing can occur. Specifically, it is contemplated to limit the average ECD of the grains to less than 0.40 μm. Preferably the emulsions are fine grain emulsions having mean grain ECD's in the range of from about 0.1 to 0.4 μm. For such fine grain emulsions nontabular grain populations are preferred. The average aspect ratio of a cubic grain emulsion is about 1.1. In the emulsions of the invention average aspect ratios of less than 1.3 are contemplated. The nontabular grains can take any convenient conventional shape consistent with the stated average aspect ratio. The grains can take regular shapes, such as cubic, octahedral or cubo-octahedral (i.e., tetradecahedral) grains, or the grains can other shapes attributable to ripening, twinning, screw dislocations, etc. Preferred grains are those bounded primarily by {100} crystal faces, since {100} grain faces are exceptionally stable.

The fine grain emulsions of the invention offer a relatively high ratio of surface area to grain volume and hence are particularly suited for rapid access processing. A common alternative approach for achieving high surface area to volume grain ratios is to employ a thin or high average aspect ratio tabular grain emulsion. A significant advantage of the fine grain emulsions contemplated for use over tabular grain emulsions and other larger grain size emulsions is that lower grain size dispersities are readily realized. Specifically, in the preferred emulsions of the invention the COV of the emulsions is less than 20 percent and, optimally, less than 10 percent.

Lower grain dispersities allow more efficient silver utilization in that a higher percentage of the total grain population can achieve near optimum sensitization. This in turn facilitates achieving optimum contrast ranges for digitally stored image reproduction. Blending of emulsions of different mean grain sizes can be used to fine tune contrast levels. It is specifically contemplated that the elements of the invention exhibit an average contrast in the range of from 1.5 to 2.0. Both the blending of emulsions and the coating of emulsions in separate superimposed layers are well known, as illustrated by *Research Disclosure,* Item 36544, I. Emulsion grains and their preparation, E. Blends, layers and performance categories, paragraphs (1), (2), (6) and (7).

The high covering power of the silver bromochloride grains allows coating coverages to be maintained at less than 40 (preferably less than 30) mg/dm$^2$, based on silver. Coating coverages for highly monodisperse emulsions as low as about 10 (preferably about 15) mg/dm$^2$ are contemplated.

The silver bromochloride emulsions can be selected from among conventional emulsions. A general description of silver halide emulsions can be found in *Research Disclosure,* Item 36544, I. Emulsion grains and their preparation. The most highly monodisperse (lowest COV) emulsions are those prepared by a batch double-jet precipitation process. It is noted that high (>50 mole percent) chloride emulsions containing minor amounts of bromide otherwise satisfying the grain requirements of this invention are commonly used for preparing photographic reflection prints. Specific examples of these emulsions are provided Hasebe et al U.S. Pat. No. 4,865,962, Suzumoto et al U.S. Pat. No. 5,252,454, and Oshima et al U.S. Pat. No. 5,252,456, the disclosures of which are here incorporated by reference. The silver bromochloride grains of conventional high chloride emulsions intended for graphic arts applications are also well suited for use in the present invention. Although reflection print and graphic arts emulsions overlap the bromide concentration ranges of this invention, less than optimum bromide levels for this invention are preferred for those applications; however, only routine adjustments during precipitation are needed to realize the preferred silver bromochloride compositions of this invention. Generally any convenient distribution bromide and chloride ions within the grains can be employed in the practice of the invention. It is generally preferred, based on convenience of preparation, to distribute bromide uniformly within the grains. Alternatively, silver bromide can be epitaxially deposited onto host grains containing lower levels of silver bromide (e.g., silver chloride host grains). The latter has the advantage of allowing the silver bromide epitaxy to act as a sensitizer.

In the course of grain precipitation one or more dopants (grain occlusions other than silver and halide) can be introduced to modify grain properties. For example, any of the various conventional dopants disclosed in *Research Disclosure,* Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference. Dopants for increasing imaging speed by providing shallow electron trapping sites (i.e, SET dopants) are the specific subject matter of *Research Disclosure,* Vol. 367, Nov. 1994, Item 36736.

Since the controlled radiation sources used to reproduce digitally stored images frequently employ short (<$10^{-1}$ second) exposure times and laser exposures in fractional microseconds are common, it is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times 10^{-9}$ mole per silver up to $1\times10^{-6}$ mole per silver mole. However, when the Ir dopant is in the form of a hexacoordination complex capable of additionally acting as a SET dopant, concentrations of up to about $5\times10^{-4}$ mole per silver, are contemplated. Specific illustrations of useful Ir dopants contemplated for reciprocity failure reduction are provided by B. H. Carroll, "Iridium Sensitization: A Literature Review", *Photographic Science and Engineering,* Vol. 24, No. 6 Nov./Dec. 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the silver bromochloride emulsions can be increased by doping the grains with a hexacoordination complex containing a nitrosyl (NO) or thionitrosyl (NS) ligand. Preferred coordination complexes of this type are disclosed by McDugle et al U.S. Pat. No. 4,933,272, the disclosure of which is here incorporated by reference.

The contrast increasing dopants (hereinafter also referred to as NO or NS dopants) can be incorporated in the grain structure at any convenient location. However, if the NO or NS dopant is present at the surface of the grain, it can reduce the sensitivity of the grains. It is therefore preferred that the NO or NS dopants be located in the grain so that they are separated from the grain surface by at least 1 percent (most preferably at least 3 percent) of the total silver precipitated in forming the silver iodochloride grains. Preferred contrast enhancing concentrations of the NO or NS dopants range from $1\times10^{-11}$ to $4\times10^{-8}$ mole per silver mole, with specifically preferred concentrations being in the range from $10^{-10}$ to $10^{-8}$ mole per silver mole.

Combinations of Ir dopants and NO or NS dopants are specifically contemplated. Where the Ir dopant is not itself a SET dopant, it is specifically contemplated to employ non-SET Ir dopants in combination with SET dopants. Where a combination of SET, non-SET Ir and NO or NS dopants are employed, it is preferred to introduce the NO or NS dopant first during precipitation, followed by the SET dopant, followed by the non-SET Ir dopant.

After precipitation and before chemical sensitization the emulsions can be washed by any convenient conventional technique. Conventional washing techniques are disclosed by *Research Disclosure,* Item 36544, cited above, Section III. Emulsion washing.

The emulsions can be chemically sensitized by any convenient conventional technique. Such techniques are illustrated by *Research Disclosure,* Item 36544, IV. Chemical sensitization. Sulfur and gold sensitizations are specifically contemplated.

Since silver bromochloride emulsions possess little native sensitivity beyond the ultraviolet region of the spectrum and controlled radiation sources used for exposure, such as lasers and LED's, are most readily constructed to provide exposures in the longer wavelength portions of the visible spectrum (e.g., longer than 550 nm) as well as the near infrared, it is specifically contemplated that one or more spectral sensitizing dyes will be absorbed to the surfaces of the silver chlorobromide grains. Ideally the maximum absorption of the spectral sensitizing dye is matched (e.g., within ±10 nm) to the exposure wavelength of the controlled exposure source. In practice any spectral sensitizing dye can be employed which, as coated, exhibits a half peak absorption bandwidth that overlaps the spectral region of exposure by the controlled exposure source.

A wide variety of conventional spectral sensitizing dyes are known having absorption maxima extending throughout the visible and near infrared regions of the spectrum. Specific illustrations of conventional spectral sensitizing dyes is provided by *Research Disclosure,* Item 18431, Section X. Spectral Sensitization, and Item 36544, Section V. Spectral sensitization and desensitization, A. Sensitizing dye.

Since solid-state controlled exposure sources tend to be more efficient at longer wavelengths of emission, it might seem most advantageous to sensitize the silver bromochloride grains to the near infrared region of the spectrum. Instead, the best matches of photographic and controlled exposure sources is found in the red region of the spectrum. In the wavelength range of from about 633 to 690 nm there are a variety of popular controlled exposure sources in widespread use, including helium-neon lasers. It is generally realized that as the peak absorption of spectral sensitizing dyes is shifted toward progressively longer wavelengths the propensity for dye-desensitization is increased. Dye-desensitization is inferred from the speed of an emulsion when sensitized to a particular wavelength is observed to be less than would be expected based on native sensitivity or sensitization with another dye with a similar or shorter maximum absorption wavelength. An abundance of spectral sensitizing dyes with low dye-desensitization characteristics with peak absorptions in the red region of the spectrum and controlled exposure sources with emissions in the red region of the spectrum renders this a preferred combination for most imaging applications. Of course, as better controlled exposure sources are developed emitting at shorter visible wavelengths are developed, the choice of preferred spectral sensitizing dyes will similarly shift.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

The silver halide emulsion and other layers forming the processing solution permeable layer units on opposite sides of the support additionally contain conventional hydrophilic colloid vehicles (peptizers and binders), typically gelatin or a gelatin derivative. Conventional vehicles and related layer features are disclosed in *Research Disclosure,* Item 36544, II. Vehicles, vehicle extenders, vehicle-like addenda and vehicle related addenda. The emulsions themselves can contain peptizers of the type set out in II. above, paragraph A. Gelatin and hydrophilic colloid peptizers. The hydrophilic colloid peptizers are also useful as binders and hence are commonly present in much higher concentrations than required to perform the peptizing function alone. The vehicle extends also to materials that are not themselves useful as peptizers. Such materials are described in II. above, C. Other vehicle components.

The elements of the invention are fully fore-hardened to facilitate rapid access processing. The use of any convenient conventional hardener is contemplated. Such hardeners are described in II. above, B. Hardeners.

To facilitate rapid access processing it is contemplated to limit the vehicle coating coverages on each side of the support. To allow dry-to-dry processing in less than 90 seconds, each processing solution permeable layer unit must be fully forehardened and limited to a hydrophilic colloid coating coverage of less than 65 mg/dm$^2$, preferably less than 45 mg/dm$^2$. By fully forehardened it is meant that no additional hardening is required during processing.

The surface overcoats SOC-1 and SOC-2 are typically provided for physical protection of the emulsion and pelloid layers. In addition to vehicle features discussed above the overcoats can contain various addenda to modify the physical properties of the overcoats. Such addenda are illustrated by *Research Disclosure,* Item 36544, IX. Coating physical property modifying addenda, A. Coating aids, B. Plasticizers and lubricants, C. Antistats, and D. Matting agents. The interlayers IL-1 and IL-2 are typically thin hydrophilic colloid layers that provide a separation between the emulsion or pelloid (particularly the former) and the surface overcoat addenda. It is quite common to locate surface overcoat addenda, particularly anti-matte particles, in the interlayers.

The pelloid layer is a preferred location for antihalation dyes. Such dyes are illustrated by *Research Disclosure,* Item 36544, Section VIII. Absorbing and scattering materials, B. Absorbing materials. The antihalation dyes absorb light that has passed through the emulsion layer to minimize light reflection and the associated reduction in image sharpness. Antihalation dyes are chosen to be decolorized during processing. Alternatively, anithalation dye can be coated in a separate processing solution permeable layer, not shown in Element I, interposed between the support and the emulsion layer.

Although the silver chlorobromide emulsions described above provide an advantageous combination of properties, both the choice of bromochloride compositions and the limited silver coating coverages render the elements either incapable or only marginally capable of detection by the infrared (IR) sensors typically contained in rapid access processors. That is, the emulsion layer, before or after processing, is incapable of significantly attenuating IR radiation in the 850 to 1100 nm spectral region. Customarily when a radiographic film is placed in a rapid access processor the refractive indices mismatch of the silver halide grains and the vehicle is relied upon to scatter an IR sensor beam directed at the film. Silver bromochloride exhibits a lower refraction index than silver bromide or iodobromide. A beam attenuation of at least 50 percent provides a signal that a radiographic film has been placed in the processor. After the film has been processed, the developed silver in a conventional radiographic element is capable of providing the required 50 percent attentuation of another, exit IR sensor. When the exit sensor beam is no longer attenuated, this provides a signal to switch the processor to a shutoff or standby mode.

To render the element of the invention reliably detectable by conventional IR radiographic film entry and exit sensors in rapid access processors, it is contemplated to incorporate in the element of the invention an infrared opacifying dye capable of reducing specular transmission through the element before, during and after processing to less than 50 percent (preferably less than 25 percent), measured at a wavelength within the spectral region of from 850 to 1100 nm. For example, if the near IR sensors employ 942 nm gallium arsenide lasers, the dye as incorporated in the cleaning element must reduce specular transmission through the cleaning element at 942 nm to less than 50 percent and, preferably, less than 25 percent. Since the sensor beam is limited to 942 nm wavelength radiation, the presence or absence of adsorption by the dye at other wavelengths is immaterial. The most efficient infrared opacifying dye choice would be a dye having a maximum absorption at (i.e., within ±10 nm) the wavelength of the sensor beams. Dyes

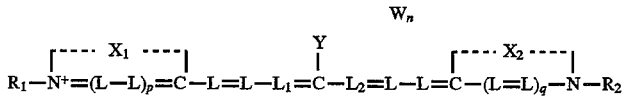

$$R_1-N^+=(L-L)_p=C-L=L-L_1=C(Y)-L_2=L-L=C-(L=L)_q-N-R_2 \quad (X_1,\ X_2,\ W_n)$$

having half peak absorption bandwidths that overlap the wavelength of the sensor beams are practically acceptable choices.

The infrared opacifying dye can be located within the element at any convenient location. It can be incorporated in the support (e.g., in the transparent film TF or in one or both of the subbing layers SL), coated on the support in any one or combination of the processing solution permeable layers. The preferred location for the infrared opacifying dye is in the pelloid layer PL.

When the infrared opacifying dye is added in one or more layers penetrated byprocessing solutions, the dye as coated must be water insoluble. Thus, for coating in this location infrared opacifying dyes are preferred that are water insoluble or that are capable of forming a water insoluble complex as coated. For example, the dye may form a water insoluble complex with gelatin. The dye can be added to hydrophilic colloid vehicle forming the layer in a water miscible solvent, such as methanol. Alternatively the dye can be added to the hydrophilic colloid in the form of solid dye particles. The maximum size of the dye particles is limited only by coating convenience. Preferably the dye particles have a mean size of less than 100 micrometers.

The infrared opacifying dyes can be selected from among conventional dyes known to exhibit a half peak bandwidth that is at least partially located within the spectral region of from 850 to 1100 nm. Water solubility can be reduced with little or no impact on absorption merely by altering the choice of substituents. Generally ionic substituents, such as acidic groups, increase water solubility while nonpolar and particularly higher molecular weight nonpolar substituents decrease water insolubility.

Dyes in the cyanine dye class are preferred infrared opacifying dyes. These dyes contain an odd number of methine (—CH=) or substituted methine groups linking two basic nuclei. The synthesis of dyes in the cyanine dye class having the required absorption in the 850 to 1100 nm range is particularly convenient, since the absorption of these dyes can be extended to longer wavelengths merely by increasing the number of methine groups linking the two basic nuclei. In preferred steric forms the dyes aggregate and exhibit batho-chromically shifted absorptions. Generally absorption in the spectral region of from 850 to 1100 nm can be realized when 7, 9 or 11 methine groups link the basic nuclei of a cyanine dye. Such dyes are termed tricarbocyanine, tetracarbocyanine and pentacarbocyanine dyes, respectively. These methine linkages can be and are usually substituted. A very common substitution, often used to promote aggregation, is for the middle (meso) methine group to be substituted. In a preferred dye selection the meso methine group and the two adjacent methine groups form part of a 5 or 6 membered ring.

Tricarbocyanine, tetracarbocyanine and pentacarbocyanine dyes are illustrated by Simpson et al U.S. Pat. No. 4,619,892, Parton et al U.S. Pat. Nos. 4,871,656, 4,975,362, 5,061,618 and 5,108,882, Davies et al U.S. Pat. No. 4,988,615, Friedrich et al U.S. Pat. No. 5,009,992, Muenter et al 5,013,642, and Hamer *The Cyanine Dyes and Related Compounds*, Interscience, 1964, Chapters VIII and IX.

Particularly preferred infrared opacifying dyes are tricarbocyanine dyes satisfying the formula: (II)

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring (that is, the methine carbon atoms are linked by 1,2-ethylene or 1,3-propylene groups);

$R_1$ and $R_2$ each independently represents an alkyl, sulfoalkyl or carboxyalkyl group (where the acid moieties can be present as a free acid, salt or ester);

Y represents an amino or sulfonyl group;

the alkyl moieties contain in each instance from 1 to 6 carbon atoms; and

W is a counterion to balance the charge of the molecule.

When Y is a sulfonyl group, it is preferably an $—SO_2R_3$ group, where $R_3$ is an aliphatic hydrocarbon or aromatic hydrocarbon containing from 1 to 10 carbon atoms. One or more heteroatoms (e.g., O, S, N) can be substituted for carbon in the aromatic hydrocarbon moleties. In a specifically preferred form $R_3$ is alkyl of from 1 to 6 carbon atoms.

When Y is an amino group, it can be a primary, secondary or tertiary amino group. Amino substituents when present can be independently selected from among alkyl and aryl substituents, typically each containing from 1 to 10 carbon atoms. Alternatively, when the amino is a tertiary amino substituent, the substituents can together with the amino nitrogen form a five or six membered heterocyclic ring. Piperidino and piperazino groups are preferred amino substituents.

Since the infrared opacifying dye remains a permanent part of the element, it must be free of any objectionable visible color. In general the opacifying dyes are chosen to be substantially colorless to the eye (e.g., to exhibit an optical density of less than 0.1 in the visible spectrum). However, opacifying dyes that appear blue can be employed, if desired, to replace the image tone controlling function of a conventional blue tinted support.

The following are illustrations of particularly preferred infrared opacifying dyes:

| | |
|---|---|
| IROD-1 | Anhydro-3,3'-bis(3-sulfobutyl)-10,12-ethylene-11-[4-(N,N-dimethylthiocarbamoyl)1-piperazino]thiatricarbocyanine triethylamine salt; |
| IROD-2 | Anhydro-3,3'-bis(3-sulfobutyl)-10,12-ethylene-11-[4-(N,N-dimethylsulfamoyl)-1-piperazino]thiatricarbocyanine triethylamine salt; |
| IROD-3 | Anhydro-3,3'-bis(3-sulfopropyl)-10,12-ethylene-11-piperidinothiatricarbocyanine triethylamine salt; |
| IROD-4 | 3,3'-Diethyl-10,12-ethylene-11-(4-methylpiperazino)thiatricarbocyanine perchlorate; |
| IROD-5 | 3,3'-Diethyl-10,12-ethylene-11-(2-methylpiperidino)thiatricarbocyanine perchlorate; |
| IROD-6 | 3,3'-Diethyl-10,12-ethylene-11-(2-methylpiperazino)benz[c]thiatricarbocyanine perchlorate; |
| IROD-7 | 3,3'-Diethyl-10,12-ethylene-11-diphenylaminothiatricarbocyanine perchlorate |
| IROD-8 | Anhydro-3,3'-bis(3-sulfopropyl)-10,12-ethylene-11-(N,N-diphenylamino)thiacarbocyanine hydroxide, triethylamine salt; |
| IROD-9 | Anhydro-3,3'-bis(3-sulfopropyl)-10,12-ethylene-11-(N-methyl-N-phenylaminothiacarbocyanine hydroxide, triethylamine salt; |
| IROD-10 | 3,3'-Diethyl-10,12-ethylene-11-(N,N-diphenylamino)benz[c]thiacarbocyanine perchlorate; |
| IROD-11 | Anhydro-3,3'-bis(3-sulfopropyl)-10,12-ethylene-11-(N,N-diphenylamino)benz[c]thiacarbocyanine hydroxide, triethylamine salt; |
| IROD-12 | Anhydro-3,3'-bis(3-sulfopropyl)-10,12-ethylene-11-(N-methyl-N-phenylamino)benz-[c]thiacarbocyanine hydroxide, triethylamine salt; |
| IROD-13 | Anhydro-3,3'-bis(2-sulfoethyl)-12,14-propylene-13-methylsulfonyl-1,1,1',1'-tetramethylbenz[e]indolotricarbocyanine hydroxide, sodium salt; |
| IROD-14 | Anhydro-3,3'-bis(3-sulfopropyl)-12,14-propylene-13-methylsulfonyl-1,1,1',1'-tetramethylbenz[e]indolotricarbocyanine hydroxide, sodium salt; |
| IROD-15 | Anhydro-3,3'-bis(3-sulfobutyl)-13-methylsulfonyl-12,14-propylene-1,1,1',1'-tetramethylbenz[e]indolotricarbocyanine hydroxide, sodium salt; |
| IROD-16 | Anhydro-3,3'-bis(3-sulfobutyl)-13-methylsulfonyl-12,14-propylene-1,1,1',1'-tetramethylbenz[e]indolotricarbocyanine hydroxide, sodium salt; |
| IROD-17 | Anhydro-3,3'-bis(3-sulfopropyl)-12,14-ethylene-13-methylsulfonyl-1,1,1',1'-tetramethylbenz[e]indolotricarbocyanine hydroxide, sodium salt; |
| IROD-18 | 3,3'-Diethyl-11-ethylsulfo-10,12-propylenebenz[c]thiacarbocyanine perchlorate. |

It has been discovered quite unexpectedly that an increase in imaging speed can be realized by incorporating a thiaalkylene bis(quaternary ammonium) salt in at least one of (1) a hydrophilic colloid layer unit of the film or (2) the developer (or activator) solution used during processing. The thiaalkylene bis(quaternary ammonium) salt acts as a development accelerator and hence its activity is dependent upon being present within the emulsion layer during development. When the thiaalkylene bis(quaternaryammonium) salt is incorporated in a developer or activator, a contemplated concentration of the development accelerator is in the range of from 0.1 to 1.0 g/L, preferably from 0.2 to 0.6 g/L.

A preferred location of the thiaalkylene bis(quaternary ammonium) salt is in the emulsion layer containing hydrophilic colloid layer unit. Processing solution permeates this entire layer unit during development and hence the thiaalkylene bis(quaternary ammonium) salt diffuses into the emulsion layer with the developer or activator solution, if it is not initially coated directly within the emulsion layer. Useful thiaalkylene bis(quaternary ammonium) salt concentrations in the hydrophilic colloid layer unit containing the emulsion layer are contemplated to range from 0.02 to 1.0 mg/dm$^2$, preferably from 0.05 to 0.60 mg/dm$^2$.

When the thiaalkylene bis(quaternary ammonium) salt is incorporated in a hydrophilic colloid layer unit on the back side of the support, it is necessary that the salt diffuse from the back side layer unit into the developer and then into the hydrophilic colloid layer unit containing the emulsion layer. In this instance somewhat higher concentrations are required than when the salt is incorporated directly in the emulsion layer containing hydrophilic colloid layer unit to achieve comparative effects.

In a preferred form the thiaalkylene bis(quaternary ammonium) salt satisfies the formula:

$$Q^1—[(CH_2)_n—S—]_m—(CH_2)_p—Q^2X \quad \text{(III)}$$

where m is an integer of from 1 to 3, n and p are independently integers of from 1 to 6, $Q^1$ and $Q^2$ are ammonio groups, and X represents the ion or ions necessary to provide charge neutrality.

Typical ammonio groups include simple acyclic groups, such as illustrated by the formula:

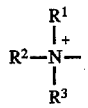

(IV)

where $R^1$, $R^2$ and $R^3$ are independent hydrocarbon groups each containing from 1 to 10 (preferably 1 to 6) carbon atoms. To facilitate solubility and mobility in processing solutions it is preferred to limit the number of carbon atoms or to substitute the hydrocarbon atoms with polar substituents, such as carboxy, sulfonyl, carbamoyl, amido, sulfamoyl or sulfonamido Groups. Preferred hydrocarbon groups are phenyl, alkylphenyl, phenylalkyl and alkyl Groups. It is specifically preferred to limit the total number of carbon atoms in any one ammonio group to 10 or less.

In an alternative preferred form $R^1$ and $R^2$ can together complete a membered ring. Where $R^1$ and $R^2$ together form an alkylene Group, typically the alkylene group contains from 4 to 10 carbon atoms. In most instances $R^1$ and $R^2$ are chosen to complete a 5 or 6 membered ring. For example, $R^1$ and $R^2$ can together complete an N—$R^3$-pyrrolio, N—$R^3$-pyrrolinio, N—$R^3$-pyrazinio, N—$R^3$-morpholinio, N—$R^3$-piperidinio or N—$R^3$-piperazinio ring.

It is specifically contemplated to employ ammonio groups illustrated by the following formula:

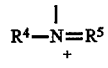

(V)

where $R^4$ and $R^5$ together complete a five or six membered ring. For example, the ammonio group can be an N—2H-pyrroleninio or N-pyridinio group.

In heterocyclic ammonio groups and particularly aromatic heterocylic ammonio groups it is not necessary that the point of attachment to the linking thiaalkylene group be at the site of the quaternized nitrogen atom. From example, ammonio groups such as 4-(N-methylpyrindinio) and N'-(N-methylpyrazinio) ammonio groups are specifically contemplated.

The charge balancing counterions can be chosen from any of the anions commonly found in silver halide emulsion layers, including halide ions (e.g., fluoride, chloride, bromide), hydroxide, phosphate, sulfate, nitrate, tetrafluoroborate, p-toluenesulfonate, and perchlorate. Anions compatible with silver halide emulsions can be used interchangeably without affecting the activity of the development accelerator.

The following are illustrations of specific thiaalkylene bis(quaternary ammonium) salts:

| | |
|---|---|
| Q-1 | N,N'-[1,8-(3,6-dithiaoctylene)]bis(1-methylpiperidinium) p-toluenesulfonate; |
| Q-2 | N,N'-[1,10-(3,8-dithiadecylene)]bis(1-methylpiperidinium) p-toluenesulfonate; |
| Q-3 | N,N'-[1,12-(3,10-dithiadodecylene)]bis(1-methylpiperidinium) p-toluenesulfonate; |
| Q-4 | N,N'-[1,8-(3,6-dithiaoctylene)]bis(1-methylmorpholinium) p-toluenesulfonate; |
| Q-5 | N,N'-[1,8-(3,6-dithiaoctylene)]bis(trimethylammonium) p-toluenesulfonate; |
| Q-6 | N,N'-[1,8-(3,6-dithiaoctylene)]bis(diethylmethylammonium) p-toluenesulfonate; |
| Q-7 | N,N'-[1,8-(3,6-dithiaoctylene)]bis(1,7-heptylenemethylammonium) p-toluenesulfonate; |
| Q-8 | N,N'-[1,8-(3,6-dithiaoctylene)]bispyridinium tetrafluoroborate; |
| Q-9 | N,N'-[1,8-(3,6-dithiaoctylene)]bis(4-dimethylaminopyridinium) bromide; |
| Q-10 | N,N'-[1,8-(3,6-dithiaoctylene)]bis(3-formylpyridinium) bromide; |
| Q-11 | N,N'-[1,8-(3,6-dithiaoctylene)]bis(4-methylpyridinium) bromide; |
| Q-12 | N,N'-[1,8-(3,6-dithiaoctylene)]bis[3-(4-methylphenylsulfonamido)pyridinium] bromide; |
| Q-13 | N,N'-[1,8-(3,6-dithiaoctylene)]bis[4-(5-nonyl)pyridinium) bromide; |
| Q-14 | N,N'-[1,8-(3,6-dithiaoctylene)]bis(3-pentamido)pyridinium) bromide; |
| Q-15 | N,N'-[1,8-(3,6-dithiaoctylene)]bis(3-propylcarbamoyl)pyridinium) bromide; |
| Q-16 | N,N'-[1,8-(3,6-dithiaoctylene)]bis(1-methylmorpholinium) p-toluenesulfonate; |
| Q-17 | N,N'-[1,13-(2,12-dihydroxy-3,6-dithiatridecylene)]bis(trimethylammonium) p-toluenesulfonate; |
| Q-18 | N,N'-[1,13-(2,12-dihydroxy-3,6-dithiatridecylene)]bis(dibutylmethylammonium) p-toluenesulfonate; |
| Q-19 | 4,4'-[1,11-(3,6,9-trithiaundecyl)]bis(N-methylpyridinium) p-toluenesulfonate; |
| Q-20 | N,N'-[1,11-(3,6,9-trithiaundecyl)]bis[4-(dimethylamino)pyridinium) bromide; |
| Q-21 | 4,4'-[1,8-(3,6-dithiaoctyl)]bis(N-methylpyridinium) perchlorate; |
| Q-22 | 2,2'-[1,8-(3,6-dithiaoctyl)]bis(N-methylpyridinium) perchlorate; |
| Q-23 | N,N'-[1,19-(7,13-dithianonadecyl)]bis(2-methylpyridinium) p-toluenesulfonate; |

Either or both of the hydrophilic colloid layer units coated on the front and back sides of the support, but most preferably the hydrophilic colloid layer unit containing the emulsion layer, can contain one or more developing agents. It is generally known that developing agents can be incorporated in a photographic or radiographic element and that development can be initiated by bringing the element into contact with an activator solution-that is, a solution otherwise similar to a developer, but lacking a developing agent. The problem that has previously been encountered in relying entirely on the element to supply the developing agent is that 1 equivalent of developing agent is required per mole of silver halide. Such large quantities of incorporated developing agent degrade the physical handling properties of a conventional element.

In the present invention the limited concentrations of silver (<40 mg/dm$^2$) allow proportionately lower developing agent concentrations and hence reduce the negative impact of incorporated developing agent on the physical handling properties of the elements of the invention. The use of a thiaalkylene bis(ammonium) salt of the type described above also allows the levels of incorporated developing agent to be reduced. It is also contemplated to employ, either incorporated in the film or in solution, a supplemental developing agent that is capable of reducing the incorporation of oxidized developing agent below 1 equivalent, preferably to 0.5 equivalent or less, and thereby allowing the restricted concentration developing agent to reduce larger amounts of silver halide than would be otherwise possible. When one or a combination of (a) lower silver coating coverages, (b) development accelerator incorporation, and (c) supplemental developing agent incorporation, it is possible to rely entirely on developing agent incorporated in the film for development and hence employ an activator solution instead of a developer processing.

It is additionally recognized that the incorporation of developing agent need not be at a sufficiently high level to replace completely developing agent in the developer. For example, one specifically contemplated function of incorporated developing agent can be to reduce the amount of developing agent that must be added to the developer in replenisher additions. Lowered concentrations of developing agent and, preferably, the supplemental developing agent, are contemplated both with and without development accelerator incorporation.

The incorporated developing agents and supplement developing agents can be of any conventional type, but are preferably of the types customarily used with rapid access processors. Preferred incorporated developing agents are hydroquinones. The following are illustrations of typical hydroquinone developers:

| | |
|---|---|
| HQ-1 | Hydroquinone; |
| HQ-2 | Methylhydroquinone; |
| HQ-3 | 2,6-Dimethylhydroquinone; |
| HQ-4 | Chlorohydroquinone; |
| HQ-5 | 2-Methyl-3-chlorohydroquinone; |
| HQ-6 | Dichlorohydroquinone; |
| HQ-7 | Bromohydroquinone; |
| HQ-9 | Hydroxyhydroquinone; |
| HQ-10 | Potassium hydroquinone sulfonate. |

The supplemental developing agents are most typically p-aminophenols, p-phenylenediamines, reductones or 3-pyrazolidinones, with the latter being most widely used in rapid access processing. The following are specific illustrations of supplemental developing agents:

| | |
|---|---|
| SDA-1 | p-Aminophenol; |
| SDA-2 | p-Methylaminophenol; |
| SDA-3 | p-Ethylaminophenol; |
| SDA-4 | p-Dimethylaminophenol; |
| SDA-5 | p-Dibutylaminophenol; |
| SDA-6 | p-Piperidinophenol; |
| SDA-7 | 4-Dimethylamino-2,6-dimethoxyphenol; |
| SDA-8 | N-Methyl-p-phenylenediamine; |
| SDA-9 | N-Ethyl-p-phenylenediamine; |
| SDA-10 | N,N-Dimethyl-p-phenylenediamine; |
| SDA-11 | N,N-Diethyl-p-phenylenediamine; |
| SDA-12 | N,N,N',N'-Tetramethyl-p-phenylenediamine; |
| SDA-13 | 4-Diethylamino-2,6-dimethoxyaniline; |
| SDA-14 | Piperidino-hexose-reductone; |
| SDA-15 | Pyrrolidino-hexose-reductone; |

-continued

| | |
|---|---|
| SDA-16 | 1-Phenyl-3-pyrazolidinone; |
| SDA-17 | 4,4-Dimethyl-1-phenyl-3-pyrazolidinone; |
| SDA-18 | 4-Hydroxymethyl-4-methyl-1-phenyl-3-pyrazolidinone; |
| SDA-19 | 4,4-Bis(hydroxymethyl)-1-phenyl-3-pyrazolidinone; |
| SDA-20 | 4,4-Dimethyl-1-tolyl-3-pyrazolidinone; |
| SDA-21 | 4,4-Dimethyl-1-xylyl-3-pyrazolidinone; |
| SDA-22 | 1,5-Diphenyl-3-pyrazolidinone. |

EXAMPLES

The invention can be better appreciated by reference to the following specific embodiments. All coating coverages, indicated parenthetically, are in mg/dm$^2$, except as otherwise indicated. Silver halide coating coverages are reported in terms of silver.

EXAMPLE 1

A series of elements of the layer arrangement of Element I, described above, were provided, but with differing silver halide grain compositions. The elements were constructed for exposure using a helium-neon 670 nm laser.

FILM SUPPORT

The film support was a conventional clear (not blue tinted) 7 mil (177.8 μm) transparent poly(ethylene terephthalate) radiographic film support.

PELLOID

The pelloid contained gelatin (25.1) and the antihalation dyes bis[3-methyl-1-(p-sulfophenyl)-2-pyrazolin-5-one-(4)] pentamethineoxonol (0.96) and 1,4-benzene sulfonic acid, 2-[3-acetyl-4-{5-[3-acetyl-1-(2,5-disulfophenyl)-1,5-dihydro-5-oxo-4H-pyrazol-4-yl-idene]-1,3-pentadienyl}-5-hydroxy-1H-pyrazol-1-yl]pentasodium salt (1.74).

SURFACE OVERCOATS

The surface overcoats contained gelatin (4.5), matte beads (0.2) and silicone lubricant (0.14).

INTERLAYERS

The interlayers contained gelatin (4.5).

EMULSION LAYER

The emulsion layer contained an emulsion comprised of sulfur and gold sensitized silver halide cubic grains (20.2) optimally spectrally sensitized with anhydro-9-ethyl-3,3'-bis(3-sulfopropyl)-4,5,4',5'-dibenzothiacarbocyanine hydroxide, sodium salt; gelatin (21.8); 4-hydroxy-6-methyl-2-methylmercapto-1,3,3A-tetraazaindene (3 g/Ag M); resorcinol (1.0) and sodium disulfocatechol (0.2). Grain sizes and silver halide compositions are set out in Table I below.

All of the hydrophilic colloid layers were fully forehardened using 2.4 wt % bis(vinylsulfonylmethyl)ether, based on the weight of gelatin.

Exposure and Processing

The elements were exposed using a helium-neon laser emitting at 670 nm. Processing was conducted using a Kodak X-OMAT 480 RA™ processor, using the processing cycle, developer and fixer, previously described.

Observations of covering power, image tone (reported in terms by b* values), and fixing time are summarized in Table I. The fixing time was taken as the time required to lower residual silver to 1.1 mg/dm$^2$.

TABLE I

| Element | ECD (μm) | Silver Halide (mol. ratio) | Cov. Power | Image Tone (b*) | Fixing Time (sec.) |
|---|---|---|---|---|---|
| E1 | 0.23 | $Br_{0.30}Cl_{0.70}$ | 18 | −2.4 | 5.6 |
| E2 | 0.24 | $I_{0.03}Br_{0.97}$ | 16 | +1.7 | 17.7 |
| E3 | 0.23 | Br | 18 | +1.1 | 7 |
| E4 | 0.23 | Cl | 13 | −7.5 | 4 |

From Table I it is apparent that the coldest image tone and the fastest fixing time were realized by Element E4 containing a AgCl emulsion. Unfortunately, this emulsion exhibited the lowest covering power. E2 and E3 demonstrate the positions of AgIBr and AgBr emulsions, halide compositions that are commonly employed in radiographic elements. The AgIBr emulsion was clearly inferior in terms of covering power, image tone and fixing time as compared to the AgBr emulsion. The AgBr emulsion exhibited a higher covering power as compared to the AgCl and AgIBr emulsion, but was otherwise unremarkable, exhibiting a positive b* value image tone and a longer fixing time than the AgCl emulsion.

Taking all performance categories into account superior properties were realized by Element E1 employing the AgBrCl emulsion. The AgBrCl emulsion provided a relatively cold image tone and a low fixing time while covering power was equal to the highest observed level. To reach a cold image tone (b* −6.5 or more negative) less blue density is required in the support of an element employing a AgBrCl emulsion and hence a better relationship between image tone and minimum density can be realized.

EXAMPLE 2

Variations of Elements E1 and E2, described above, were constructed varying the coating coverages of the silver halide (stated in mg/dm$^2$ silver) and, in some elements, adding an infrared opacifying dye at varied coating coverages (stated in mg/dm$^2$) to the pelloid layer.

The percent of a 942 nm gallium arsenide laser beam attenuated by the various unprocessed elements is shown in Table II.

TABLE II

| Element | AgIBr | AgBrCl | IROD-1 | % Atten. |
|---|---|---|---|---|
| E5 | 0 | 0 | 0 | 11 |
| E6 | 2.7 | 0 | 0 | 23 |
| E7 | 5.4 | 0 | 0 | 32 |
| E8 | 10.9 | 0 | 0 | 47 |
| E9 | 21.8 | 0 | 0 | 59 |
| E10 | 0 | 2.7 | 0 | 15 |
| E11 | 0 | 5.4 | 0 | 18 |
| E12 | 0 | 10.9 | 0 | 21 |
| E13 | 0 | 21.8 | 0 | 23 |
| E14 | 0 | 10.9 | 0.11 | 25 |
| E15 | 0 | 10.9 | 0.22 | 42 |
| E16 | 0 | 10.9 | 0.44 | 69 |

From Table II it should be noticed that 21.8 mg/dm$^2$ AgIBr, a fully acceptable coating coverage level, is sufficient to exceed the 50 percent attentuation level that is sought for the presence of a film to be detected by a rapid access processor input IR sensor. On the other hand, from the AgBrCl coating coverage series it is apparent that three successive doublings of the silver coating coverage created only a very slow increase in infrared attenuation. Hence, it is apparent that a maximum acceptable 40 mg/dm$^2$ silver coverage would have been exceeded well before attenuation reached an acceptable 50 percent level.

The coatings with successively higher levels of the infrared opacifying dye show that even small increases in the levels of the dye markedly increased the percent attentuation. Thus, the deficiency of the AgBrCl emulsion in attenuating infrared radiation can be readily overcome by the addition of relatively low levels of infrared opacifying dye.

EXAMPLE 3

Gelatin (32.7) was coated on a transparent poly(ethylene terephthalate) radiographic film support. The gelatin was hardened with 1 wt % bis(vinylsulfonylmethyl)ether. The gelatin contained varied amounts of infrared opacifying dye, shown in Table III.

The transmittance of the film samples were determined by placing the unprocessed film between and in contact with a 942 rum gallium-arsenide laser and an infrared detector of the type used as an input film detector in a rapid access processor.

TABLE III

| Dye | Coverage (mg/dm$^2$) | Percent Transmittance | Color |
|---|---|---|---|
| None | 0 | 80 | Clear |
| IROD-7 | 0.33 | 50 | Clear |
| IROD-7 | 0.66 | 35 | Clear |
| IROD-7 | 0.99 | 30 | Sl. Blue |
| IROD-1 | 0.33 | 41 | Clear |
| IROD-1 | 0.66 | 8 | Sl. Blue |
| IROD-1 | 0.99 | 4 | Blue |

Sl. = slightly (i.e., just noticeably)

From Table III it is apparent that IROD-1 and IROD-7 were both effective in reducing infrared transmittance to levels below 50%. The blue coloration imparted by dye addition was an advantage in that it can be used to impart the desired cold image tone to a processed element. IROD-1, a preferred infrared opacifying dye, reduced transmittance to a greater degree and produced a blue tint at lower concentrations than IROD-7.

When 942 nm radiation absorption of the coatings were measured before and after processing in a KODAK X-OMAT 480 RA™ rapid access processor as specifically described above, no significant change in absorption was measured. From this it was concluded by IROD-1 and IROD-7 both form a permanent part of the elements and are not removed to any significant extent during processing. Thus, each are capable of being detected both by input and output IR sensors associated with the processor.

EXAMPLE 4

A series of elements were constructed to demonstrate the speed increases that can be realized by incorporating a thiaalkylene bis(ammonium salt) in a film of the type contemplated by the invention.

A film support similar to that of Example 1 was employed. Onto the film support was coated a gelatin layer (10.8), which in some instances contained a development accelerator candidate compound (0.55), identified in Table IV.

Over the gelatin layer was coated an emulsion layer comprised of gelatin (26.9) and sulfur and gold sensitized $AgBr_{0.30}Cl_{0.70}$ (19.4) optimally spectrally sensitized with anhydro-9-ethyl-3,3'-bis(3-sulfopropyl)-4,5,4',5'-dibenzothiacarbocyanine hydroxide, sodium salt. The emulsion contained cubic silver bromochloride grains having an average ECD of 0.147 μm.

Over the emulsion layer was coated gelatin (6.5). All of the above layers were fully forehardened using 2.5 wt % bis(vinylsulfonylmethyl)ether, based on the weight of total gelatin.

The elements were identically exposed to red light using a Wratten 29™ filter, which transmits light at wavelengths longer than 600 nm. Processing was conducted using the processing cycle, developer and fixer previously described for use with Kodak X-OMAY 480 RA™, except that in this Example a Kodak X-OMAT M-6™ processor was employed. Speed was measured at a density of 1.0. Speed is reported in relative log units (0.30 log E=30 relative log units, where E represents exposure in lux-seconds).

The results are summarized in Table IV.

TABLE IV

| Addenda | Relative Speed |
|---|---|
| None | 194 |
| C-1 | 194 |
| C-2 | 187 |
| C-3 | 174 |
| Q-1 | 212 |
| Q-2 | 215 |
| Q-3 | 214 |

C-1 N,N'-(1,10-decylene)bis(pyridinium) chloride;
C-2 1,1'-[1,6-(2,5-dithiahexylene)]bis(carboxylic acid); and
C-3 4,4'-[1,8-(3,6-dithiaoctylene)]bis(pyridine)

It is apparent from Table IV that the thiaalkylene bis (ammonium salt) compounds Q-1, Q-2 and Q-3 increase speed by approximately a half stop (0.15 log E). The comparative compound C-1, which differs from a thiaalkylene bis(ammonium salt) structure by the absence of divalent sulfur atoms, fails to produce any significant increase in speed. This demonstrates that the divalent sulfur atoms are essential components of the compounds that act as .development accelerators. Similarly, comparative compound C-2, which replaces the ammonio groups with carboxy groups, also fails to produce any significant increase in speed, thereby demonstrating that the ammonio groups are also essential to obtaining development acceleration. Finally, comparative compound C-3, which substitutes trivalent nitrogen for quaternized nitrogen, also fails to produce a significant speed increase, thereby demonstrating that quaternized nitrogen is essential to obtaining development acceleration.

EXAMPLE 5

A series of elements were prepared and tested similarly as in Example 4, except that the emulsion contained cubic $AgBr_{0.30}Cl_{0.70}$ grains having a mean ECD of 0.22 μm. Further, instead of adding to a gelatin undercoat, the varied compound was added directly to the emulsion layer in the concentration shown in Table V.

The results are summarized in Table V.

TABLE V

| Addenda | Relative Speed |
|---|---|
| None | 220 |
| Q-1(0.11) | 226 |
| Q-1(0.22) | 229 |
| Q-1(0.44) | 232 |
| Q-2(0.22) | 230 |
| Q-3(0.22) | 228 |
| C-1(0.11) | 220 |
| C-1(0.11) | 220 |
| C-2(0.22) | 218 |
| C-3(0.22) | 197 |
| C-4(0.22) | 221 |
| C-5(0.11) | 215 |
| C-5(0.22) | 212 |
| C-5(0.44) | 204 |
| C-6(0.22) | 219 |
| C-7(0.22) | 220 |

C-4 N,N'-(1,10-decylene)bis(1-methylmorpholinium) p-toluenesulfonate;
C-5 1,10-dihydroxy-3,6-dithiaoctane;
C-6 N,N'-(1,6-hexylene)bis(trimethylammonium) chloride;
C-7 N,N'-[1,8-(3,6-disulfooctane)bispyridinium methylsulfonate;

The results shown in Table V are consistent with the results reported in Table IV. This demonstrates that the thiaalkylene bis(ammonium salt) structure is required to achieve speed enhancement. The results are confirmed at varied concentration levels, and it is demonstrated that the thialkylene bis(ammonium salt) produces similar results whether placed in the emulsion layer or a gelatin undercoat.

EXAMPLE 6

Two series of films were constructed as described in Example 1, but using the emulsions of Example 1, Element E1 and Example 4. The development accelerator Q-4 was placed in the developer in the concentrations shown in Table VI. Red exposures were used as described in Example 4. Processing was conducted as in Example 1, except that development time was extended to 30 seconds. Speed was again measured at a density of 1.0, as in Example 4.

The results are summarized in Table VI.

TABLE VI

| ECD (μm) | Q-4 (mg/L) | Dmin | Dmax | Relative Speed |
|---|---|---|---|---|
| 0.23 | 0 | 0.10 | 4.21 | 270 |
| 0.23 | 50 | 0.10 | 4.23 | 278 |
| 0.23 | 200 | 0.16 | 4.19 | 293 |
| 0.23 | 400 | 0.26 | 4.15 | 307 |
| 0.147 | 0 | 0.05 | 4.06 | 233 |
| 0.147 | 50 | 0.06 | 4.07 | 239 |
| 0.147 | 200 | 0.08 | 3.98 | 251 |
| 0.147 | 400 | 0.19 | 3.90 | 263 |

It is demonstrated in Table VI that a large increase in speed is provided by the thialkylene bis(ammonium salt) development accelerator with little impact on either maximum or minimum density levels.

EXAMPLE 7

A series of elements were constructed to demonstrate the effect of incorporated development accelerator and/or supplemental developing agent on observed levels of speed in elements containing an incorporated developing agent.

A film support similar to that of Example 1 was employed. Onto the film support was coated an emulsion layer comprised of gelatin (32.7) and sulfur and gold sensitized $AgBr_{0.30}Cl_{0.70}$ (21.8) optimally spectrally sensitized with anhydro-9-ethyl-3,3'-bis(3-sulfopropyl)-4,5,4',5'-dibenzothiacarbocyanine hydroxide, sodium salt. The emulsion contained cubic silver bromochloride grains having an average ECD of 0.23 μm. The developing agent HQ-1 or HQ-10 was incorporated in the emulsion layer in a concentration of 0.5 equivalents (5.5 or 11.6 mg/dm$^2$, respectively). A supplemental developing agent and development accelerator incorporations were varied, as shown in Table VII.

Over the emulsion layer was coated gelatin (6.5). All of the above layers were fully forehardened using 2.5 wt % bis(vinylsulfonylmethyl)ether, based on the weight of total gelatin.

The elements were identically exposed to red light using a Wratten 29™ filter, which transmits light at wavelengths longer than 600 nm. The elements were identically developed for 20 seconds at 35° C. using Kodak Royalprint™ activator, fixed for 30 seconds using the fixer composition previously described, and then washed in water for 2 minutes.

The results using HQ-1 are summarized in Table VII and the results using HQ-10 are summarized in Table VIII.

TABLE VII

| SDA-18 | Q-1 | Dmin | Dmax | Relative Speed |
|---|---|---|---|---|
| 0 | 0 | 0.06 | 2.84 | 234 |
| (0.22) | 0 | 0.06 | 3.07 | 243 |
| (0.22) | (0.11) | 0.07 | 2.88 | 251 |
| (0.22) | (0.22) | 0.07 | 2.96 | 256 |
| (0.44) | 0 | 0.06 | 2.95 | 248 |
| (0.44) | (0.11) | 0.07 | 3.01 | 262 |
| (0.44) | (0.22) | 0.08 | 2.94 | 260 |

TABLE VIII

| SDA-18 | Q-1 | Dmin | Dmax | Relative Speed |
|---|---|---|---|---|
| 0 | 0 | 0.06 | 1.53 | 132 |
| 0 | (0.11) | 0.06 | 1.82 | 165 |
| 0 | (0.22) | 0.06 | 2.18 | 182 |
| 0 | (0.44) | 0.06 | 2.57 | 187 |
| (0.11) | 0 | 0.06 | 2.63 | 187 |
| (0.22) | 0 | 0.06 | 3.04 | 196 |
| (0.44) | 0 | 0.06 | 3.20 | 211 |
| (0.11) | (0.11) | 0.06 | 2.88 | 206 |
| (0.11) | (0.22) | 0.06 | 3.17 | 206 |
| (0.11) | (0.44) | 0.07 | 3.36 | 223 |
| (0.22) | (0.11) | 0.06 | 3.07 | 207 |
| (0.22) | (0.22) | 0.06 | 3.17 | 219 |
| (0.22) | (0.44) | 0.06 | 3.39 | 227 |
| (0.44) | (0.11) | 0.07 | 3.27 | 210 |
| (0.44) | (0.22) | 0.08 | 3.26 | 217 |
| (0.44) | (0.44) | 0.10 | 3.48 | 236 |

From Tables VII and VIII it is apparent that each of supplemental developing agent and development accelerator are capable of enhancing speed, but the highest levels of speed are realized when both are present. All incorporation levels shown provided satisfactory imaging results.

EXAMPLE 8

Exposure and processing of separate samples of the same series of elements shown in Table VIII were repeated, except that instead of using an activator solution Developer A was diluted to one quarter of its original strength.

The results are summarized in Table IX.

TABLE IX

| SDA-18 | Q-1 | Dmin | Dmax | Relative Speed |
|---|---|---|---|---|
| 0 | 0 | 0.06 | 3.37 | 223 |
| 0 | (0.11) | 0.06 | 3.36 | 232 |
| 0 | (0.22) | 0.06 | 3.42 | 230 |
| 0 | (0.44) | 0.06 | 3.31 | 235 |
| (0.11) | 0 | 0.06 | 3.38 | 223 |
| (0.22) | 0 | 0.06 | 3.44 | 222 |
| (0.44) | 0 | 0.06 | 3.37 | 222 |
| (0.11) | (0.11) | 0.06 | 3.33 | 231 |
| (0.11) | (0.22) | 0.06 | 3.42 | 231 |
| (0.11) | (0.44) | 0.07 | 3.33 | 238 |
| (0.22) | (0.11) | 0.06 | 3.41 | 229 |
| (0.22) | (0.22) | 0.07 | 3.40 | 230 |
| (0.22) | (0.44) | 0.07 | 3.31 | 236 |
| (0.44) | (0.11) | 0.06 | 3.43 | 228 |
| (0.44) | (0.22) | 0.06 | 3.43 | 231 |
| (0.44) | (0.44) | 0.07 | 3.13 | 244 |

When a film sample lacking both Q-1 and SDA-18 were processed using the standard rapid access processing employed in Example 1, a relative speed of 223 was observed. From Table IX it can be seen that the development accelerator allowed recapture of the speed lost by diluting the developer, whereas the supplemental developing agent had little impact on speed. Although the elements with higher speeds show preferred performance characteristics, all of the elements tested exhibited acceptable performance characteristics.

EXAMPLE 9

The effect of incorporated developing agent on the physical properties of the film was ascertained by employing a film sample according to Example 8 containing no incorporated development accelerator or supplemental developing agent. The developing agent HQ-10 was incorporated at varied levels, as shown in Table X.

TABLE X

| (mg/dm$^2$) | Equivalents | Mushiness | Tackiness |
|---|---|---|---|
| 0 | 0 | 121 | 3 |
| (2.3) | 0.125 | 122 | 3 |
| (5.8) | 0.25 | 108 | 3 |
| (11.6) | 0.5 | 103 | 3 |
| (17.3) | 0.75 | 99 | 10 |
| (23.1) | 1.0 | 82 | 10 |

Tackiness was measured on an arbitrary scale where a rating of 1 indicates the film was not tacky and a rating of 10 indicates that the film blocks (adheres to another film placed in contact with it). Mushiness was measured in terms of the weight in grams applied that had to be applied to a stylus to create a gauge (plow) in the film coating. Both tackiness and mushiness were within acceptable limits when the development agent was present in a concentration of 0.5 equivalent or less.

EXAMPLE 10

An element according to the invention, E17, was constructed similarly as Element E1 (see Example 1), except that the mean grain ECD was 0.26 μm, the silver coverage was 21.4 mg/dm$^2$, and the emulsion layer contained Q-1 (0.05).

A control element, E18, was constructed similarly as element E17, except that the emulsion was that employed in Element E2 (see Example 1).

Six hundred samples (each sample was a 14×17 inch, 35.6×43.2 cm, sheet) of each element were exposed and identically processed as in Example 1, but with replenishment of developer and fixer as described below.

Samples of element E18 were processed with standard replenishment of developer and fixer. That is, 60 mL of developer and 90 mL of fixer was added after each sheet was processed. The results are summarized in Table XI. Speed was measured at a density of 1.0. Dmax* is the density observed at an exposure of 1.1 log E greater than the exposure required to produce a density of 0.2 above Dmin.

TABLE XI

| Sheet Processed | Dmin | Dmax* | Speed |
|---|---|---|---|
| 1st | 0.18 | 3.75 | 293 |
| 300th | 0.19 | 3.79 | 297 |
| 600th | 0.19 | 3.73 | 296 |
| Δ(1–600) | 0.01 | −0.02 | 3 |

The comparison of Table XI was next repeated, except that the developer and fixer replenishment were each reduced to 20 mL/sheet. The results are summarized in Table XII.

TABLE XII

| Sheet Processed | Dmin | Dmax* | Speed |
|---|---|---|---|
| 1st | 0.18 | 3.50 | 288 |
| 300th | 0.18 | 2.84 | 282 |
| 600th | 0.18 | 2.63 | 273 |
| Δ(1–600) | 0.01 | −0.87 | −15 |

A comparison of Tables XI and XII reveals that reduced replenishment resulted in significant loss of maximum density and speed.

The comparisons reported in Tables XI and XII were repeated, except that sheets of element E17 were substituted for sheets of element E18. The results with replenishment rates employed in Table XI are reported in Table XIII, and the results with replenishment rates employed in Table XII are reported in Table XIV.

TABLE XIII

| Sheet Processed | Dmin | Dmax* | Speed |
|---|---|---|---|
| 1st | 0.20 | 4.10 | 295 |
| 300th | 0.20 | 4.13 | 294 |
| 600th | 0.20 | 4.08 | 294 |
| Δ(1–600) | 0.00 | −0.02 | −1 |

TABLE XIV

| Sheet Processed | Dmin | Dmax* | Speed |
|---|---|---|---|
| 1st | 0.22 | 4.17 | 294 |
| 300th | 0.21 | 4.13 | 296 |
| 600th | 0.21 | 4.13 | 297 |
| 1200th | 0.21 | 4.09 | 295 |
| Δ(1–1200) | −0.01 | −0.08 | 1 |

In comparing Tables XIII and XIV it is apparent that element E17 of the invention exhibited much less variance as a function of reduced replenishment than the control element E18. Further, element E17 showed less variance in performance, even when processing was extended over 1200 successive sheets of film with reduced replenishment. This demonstrates the marked improvement of the elements of the invention.

The invention has been described in detail with particular reference to preferred embodiments thereof, but it will be understood that variations and modifications can be effected within the spirit and scope of the invention.

What is claimed is:

1. A radiation-sensitive silver halide film for reproducing digitally stored medical diagnostic images through a series of laterally offset exposures by a controlled radiation source followed by processing in 90 seconds or less, including development, fixing and drying, comprised of a transparent film support and, coated on the support, a hydrophilic colloid layer unit containing a silver halide emulsion, wherein (A) the film exhibits an average contrast in the range of from 1.5 to 2.0, measured over a density above fog of from 0.25 to 2.0, (B) the emulsion layer (1) contains silver bromochloride grains including grain faces lying in {100} crystal planes (a) comprised of from 20 to 40 mole percent bromide, based on total silver, (b) having a mean equivalent circular diameter of less than 0.40 μm, (c) exhibiting an average aspect ratio of less than 1.3, and (d) coated at a silver coverage of less than 40 mg/dm$^2$, and (2) has adsorbed to the surfaces of the silver bromochloride grains at least one spectral sensitizing dye having an absorption half peak bandwidth in the spectral region of exposure by the controlled radiation source, and (C) the film contains an infrared opacifying dye that is capable of reducing specular transmission through the film before, during and after processing to less than 50 percent, measured at a wavelength within the spectral region of from 850 to 1100 nm.

2. A film according to claim 1 wherein the silver bromochloride grains exhibit a coefficient of variation of grain size of less than 20 percent.

3. A film according to claim 1 wherein the silver bromochloride grains are coated at a coverage in the range of from 10 to 30 mg/dm$^2$, based on silver.

4. A film according to claim 1 wherein the silver bromochloride grains are cubic or tetradecahedral grains.

5. A film according to claim 1 wherein the infrared opacifying dye is coated in a processing solution permeable layer unit coated on a side of the support opposite the emulsion layer.

6. A film according to claim 1 wherein the infrared opacifying dye is a tricarbocyanine, tetracarbocyanine or pentacarbocyanine dye.

7. A film according to claim 1 wherein the opacifying dye satisfies the formula:

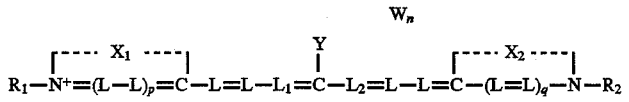

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring;

$R_1$ and $R_2$ each independently represents an alkyl, sulfoalkyl or carboxyalkyl group;

Y represents an amino or sulfonyl group;

the alkyl moleties contain in each instance from 1 to 6 carbon atoms; and

W is a counterion to balance the charge of the molecule.

8. A film according to claim 7 wherein the infrared opacifying dye is a 10,12-ethylene-11-[4-(N,N-dialkylthiocarbamoyl)-1-piperazino]thiatricarbocyanine.

9. A film according to claim 7 wherein the infrared opacifying dye is a 10,12-ethylene-11-(N,N-diphenylamino)thiatricarbocyanine.

10. A film according to claim 1 wherein the film contains a hydrophilic colloid coating coverage on each side of the support of less than 45 mg/dm$^2$.

11. A film according to claim 1 wherein a colloid layer contains a thiaalkylene bis(ammonium salt).

12. A film according to claim 11 wherein the thiaalkylene bis(ammonium salt) is located in the hydrophilic colloid layer unit containing the silver halide emulsion.

13. A film according to claim 12 wherein the thiaalkylene bis(ammonium salt) is incorporated in a concentration of from 0.02 to 1.0 mg/dm$^2$.

14. A film according to claim 11 wherein the thiaalkylene his(ammonium salt) satisfies the formula:

$$Q^1—[(CH_2)_n—S—]_m—(CH_2)_p—Q^2X$$

where m is an integer of from 1 to 3, n and p are independently integers of from 1 to 6, $Q^1$ and $Q^2$ are ammonio groups, and X represents the ion or ions necessary to provide charge neutrality.

15. A film according to claim 1 wherein a developing agent is incorporated in a hydrophilic colloid layer of the film.

16. A film according to claim 15 wherein the concentration of the developing agent is limited to 1 equivalent, based on silver.

17. A film according to claim 15 wherein a hydroquinone developing agent is incorporated.

18. A film according to claim 17 wherein a supplemental developing agent is additionally incorporated chosen from the group consisting of p-aminophenols, p-phenylenediamines, reductones and 3-pyrazolidinones.

19. A film according to claim 15 wherein a combination of a hydroquinone developing agent, a 3-pyrazolidinone and a thiaalkylene bis(ammonium salt) are incorporated in the film.

* * * * *